US006480766B2

(12) United States Patent
Hawthorne et al.

(10) Patent No.: US 6,480,766 B2
(45) Date of Patent: Nov. 12, 2002

(54) METHOD OF DETERMINING TRAIN AND TRACK CHARACTERISTICS USING NAVIGATIONAL DATA

(75) Inventors: Michael J. Hawthorne, Watertown, NY (US); Stephen K. Nickles, Burleson, TX (US); John E. Haley, Burleson, TX (US)

(73) Assignee: New York Air Brake Corporation, Watertown, NY (US)

( * ) Notice: Subject to any disclaimer, the term of this patent is extended or adjusted under 35 U.S.C. 154(b) by 0 days.

(21) Appl. No.: 09/847,318

(22) Filed: May 3, 2001

(65) Prior Publication Data

US 2002/0010531 A1 Jan. 24, 2002

Related U.S. Application Data

(63) Continuation-in-part of application No. 09/624,049, filed on Jul. 24, 2000, now Pat. No. 6,311,109.

(51) Int. Cl.[7] ..... G08G 1/123

(52) U.S. Cl. ..... 701/19; 701/20; 246/122 R; 342/357.13

(58) Field of Search ..... 701/19, 20, 213; 246/122 R, 3, 123, 162, 158, 176, 201, 167 D, 217, 220; 342/357.07, 357.01, 357.03, 357.08, 357.13

(56) References Cited

U.S. PATENT DOCUMENTS

| | | | | |
|---|---|---|---|---|
| 4,638,438 A | | 1/1987 | Endo et al. | 701/212 |
| 4,807,127 A | | 2/1989 | Tenmoku et al. | 701/207 |
| 4,863,123 A | | 9/1989 | Bernard et al. | 246/122 R |
| 5,129,605 A | | 7/1992 | Burns et al. | 246/5 |
| 5,334,986 A | | 8/1994 | Fernhout | 342/357.14 |
| 5,374,933 A | | 12/1994 | Kao | 342/357.13 |
| 5,394,333 A | | 2/1995 | Kao | 701/217 |
| 5,437,422 A | * | 8/1995 | Newman | 246/5 |
| 5,574,649 A | | 11/1996 | Levy | 701/207 |
| 5,590,856 A | | 1/1997 | Quinn et al. | 246/219 |
| 5,740,547 A | | 4/1998 | Kull et al. | 114/273 |
| 5,791,063 A | * | 8/1998 | Kesler et al. | 33/651 |
| 5,809,448 A | * | 9/1998 | Gimenez et al. | 701/213 |
| 5,867,122 A | | 2/1999 | Zahm et al. | 342/357.07 |
| 5,969,643 A | | 10/1999 | Curtis | 340/988 |
| 6,081,769 A | | 6/2000 | Curtis | 702/158 |
| 6,128,558 A | | 10/2000 | Kernwein | 701/19 |
| 6,135,396 A | * | 10/2000 | Whitfield et al. | 246/182 R |
| 6,218,961 B1 | | 4/2001 | Gross et al. | 340/903 |
| 6,246,956 B1 | * | 6/2001 | Miyoshi et al. | 701/117 |

OTHER PUBLICATIONS

Vehicle Positioning—Do you know where your train is?, *Railway Age*, Feb. 1996, pp. 41–42.

* cited by examiner

*Primary Examiner*—Tan Nguyen
(74) *Attorney, Agent, or Firm*—Barnes & Thornburg

(57) ABSTRACT

A method using the position data being determined on the train to determine characteristics of the train and/or the track. This is achieved by providing position determining devices at two or more spaced locations along the train. The position of the two locations are determined by the position determining devices. A processor determines the difference between the two locations from the positions determined by the position determining devices and determines the characteristics of the train from the determined difference between the two locations.

4 Claims, 5 Drawing Sheets

METHOD OF DETERMINING TRAIN AND TRACK CHARACTERISTICS USING NAVIGATIONAL DATA

CROSS-REFERENCE

This is a continuation-in-part application of U.S. patent application Ser. No. 09/624,049 filed Jul. 24, 2000, now U.S. Pat. No. 6,311,109.

BACKGROUND AND SUMMARY OF THE INVENTION

The present invention relates generally to determining the position of trains on a track and more specifically to determining characteristics of the train and/or track from the position of the train.

With the advent of train control systems, train scheduling systems and train separation, the location of a train on a particular track and its relationship to other trains and track structures is becoming increasingly important. Providing additional intelligence on the train as well as in central locations depend upon the accurate position of a train on a particular track. Global positioning systems (GPS) and other devices have been used to determine the position of the train. Data bases are provided on the locomotive as a point of comparison. Other input devices such as turn rate indicators, compasses, tachometers and odometers also provide additional information used to determine the position of the locomotive. Examples of such systems are illustrated in U.S. Pat. Nos. 5,129,605; 5,740,547; and 5,867,122. Due to the limit of accuracy of GPS data, U.S. Pat. No. 6,128,558 suggests using machine vision to detect relative locomotive position on a parallel track.

Another system which includes not only determining location but displaying control of a locomotive is described in U.S. Pat. No. 6,144,901 which is incorporated herein by reference. This system is directed to the LEADER System available from New York Air Brake Corporation in Watertown, N.Y.

The present invention makes use of the position data being determined on the train to determine characteristics of the train and/or the track. This is achieved by providing position determining devices at two or more locations along the train. The position of the locations are determined by the position determining devices. A processor determines the difference between the locations from the positions determined by the position determining devices and determines the characteristics of the train from the determined difference between the two locations.

For example, the locations of the position determining devices may be at the head end and rear end of the train. Thus, the differences of the two locations would determine the length of the train. The position is preferably taken when the train is traveling along a flat, straight track. This removes the curvature from the determination as well as any run-in or run-out which would lengthen or shorten the train if it is not flat.

The number of vehicles in the train are also determined and used to estimate the length of the train. The estimated length of the train is compared to the length of the train determined from the position determining devices and any discrepancies are determined. The discrepancies may then be reported. The number of vehicles in the train is determined either from a listing of the vehicles on the train or from the number of axles recorded in a hot box detection system on the train.

A plurality of lengths may be determined and the longest length selected as a length of the train. A plurality of sets of positions can be determined and the change of differences between the positions determined. This change of differences is used to determine a characteristic of the train. This will include run-in and run-out as well as in train forces.

The position determining devices can also determine the elevation of its location. The processor would then derive the grade of the track the train currently occupies from the determined difference of positions and elevations. This provides one track profile characteristic. The heading of each of the position determining devices will be used to derive a track profile with respect to curves.

Track structure information as a function of position and time is also provided to the processor. The track structure is entered at one of the positions of the position determining devices. This is correlated with the other information to provide additional information of the track profile. Track structures may be manually introduced while the other data from the position determining devices are automatically collected. Track structures include one or more of mileposts, bridges, tunnels, signals, crossings, overpasses, underpasses, siding, parallel tracks and whistle posts. The distance traveled along a track as a function of time is also used to derive the track profile.

The collecting of the data and the deriving of the track profile is performed as the vehicle travels the track. Thus, this not only provides information of the characteristics of the train, it also provides a track profile. If the track profile already exists, this method verifies, updates or corrects the pre-existing track profile in the processor. Also, using two or more positions determined by the position determining devices and correlating them to a track profile data base stored on the train, a more accurate determination of the location of the train on the track would result. Additional positioning locating devices may be provided along the train and provide position information to the processor. Preferably, the position determining devices are Global Positioning Systems.

When a train has passed over a switch in the track, determining two positions of the train before and after the switch and a comparison of these positions to the data base is used to determine which branch track the train is on. The two positions on each side of the switch may be determined simultaneously at two spaced portions of the train. Alternatively, the two positions are determined sequentially as the train passes from one side to the other side of the switch. An error is determined for the first position prior to the track by comparison to the first position of the data base and the same error is assumed for the second determined position past the track. This increases the accuracy of determining which branch the train is on.

Discrepancies can also be determined in the train consist definition as the train rolls across the track. This method includes storing a list on the train of the vehicles in the train. A report from the hot box detection system positioned along the track is stored on the train. The report includes the number of axles of the train monitored by the detection system. The list of cars is compared to the report for the number of axles to determine discrepancies. Any discrepancies are reported. The discrepancies would indicate that the stored list is inaccurate or the hot box detection system is faulty.

Other objects, advantages and novel features of the present invention will become apparent from the following detailed description of the invention when considered in conjunction with the accompanying drawings.

DETAILED DESCRIPTION OF THE PREFERRED EMBODIMENTS

Figures 1A, 1B, 1C:
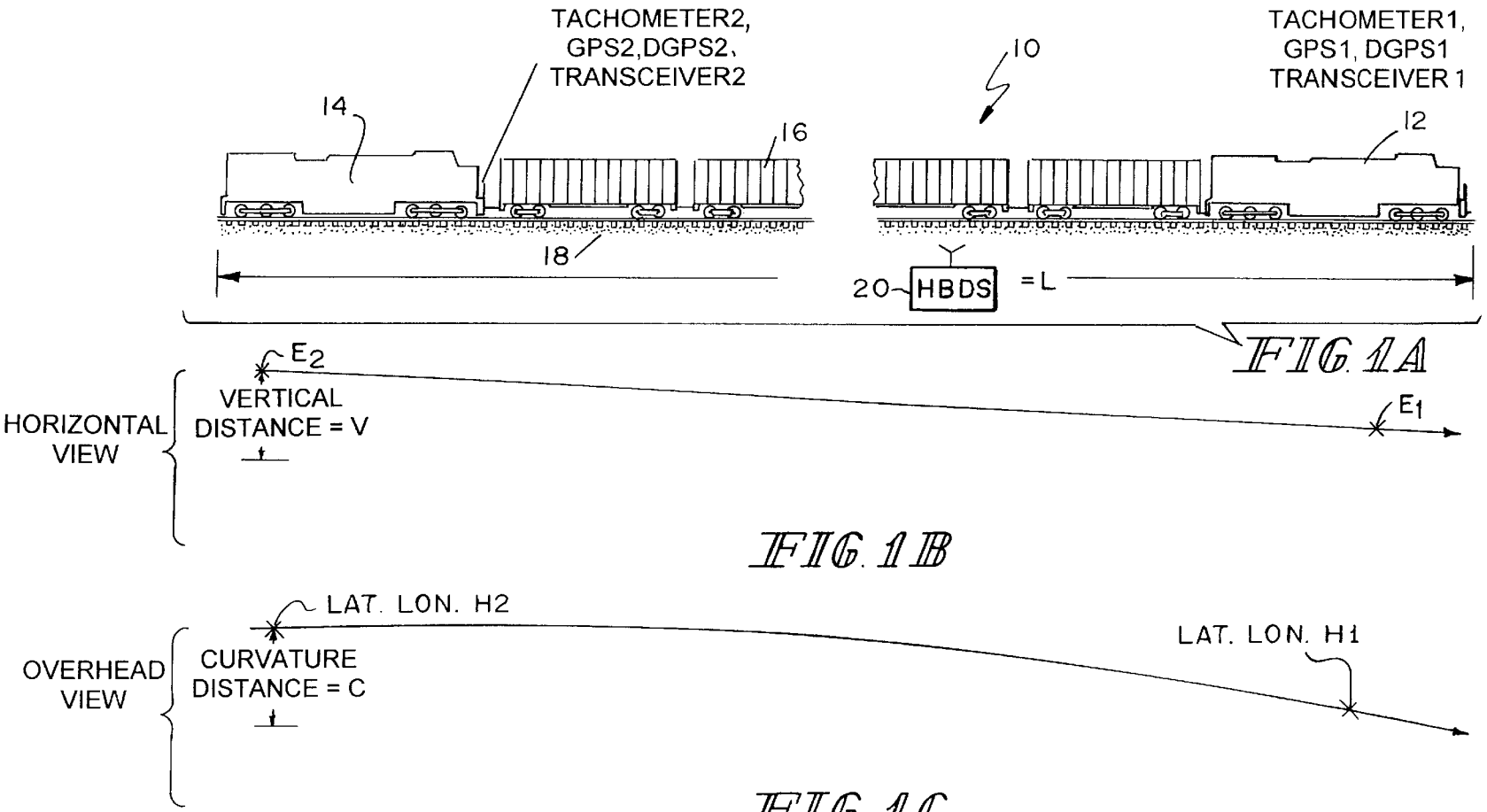
FIG. 1A is a horizontal view of a train on a flat track incorporating the principles of the present invention.
FIG. 1B is a horizontal view of a track having a grade G.
FIG. 1C is an overhead view of a track having a curvature C.

A train 10 shown in FIG. 1A includes a lead locomotive 12, a trailing locomotive 14 and a plurality of cars 16 therebetween. Additional locomotives may be placed intermediate the train or at the front or trailing end of the train. The train 10 rides on tracks 18. The head locomotive 12 includes a tachometer or any other device to measure distance travel, a navigational receiver shown as a GPS and a differential GPS, and a transceiver. These have become standard equipment on locomotives to determine their position. At least one other navigational transceiver is provided in another point of the train. Preferably, as illustrated, the navigational receiver, including a GPS and a differential GPS as well as a transceiver, are placed at the end of train locomotive 14. An additional tachometer may be provided.

Although a pair of navigational receivers or position determining devices are shown and will be used in the following examples, a plurality of position determining devices with appropriate transceivers may be provided at multiple locations along the train. With additional position determining devices or navigational transceivers, the accuracy of the train and track characteristic to be determined or derived is increased. It should be noted that transceivers provided at the position determining devices are radio transceivers communicating with each other. There may also be transceivers on a wire running through the train. If the train is not completely wired, a radio or other form of wireless transmission will be required.

Various characteristics of the train and the track may be determined or derived using the spaced position determining devices. For example, the length of the train may be determined from the difference of the longitude and latitude of the position determining devices in the locomotives 12 and 14. To determine the true length of the train using the longitude and latitude received from the navigational receivers, the train should be on a straight track and also should be on a level track. If it is not on a straight track or a level track, the longitude and latitude information will not provide a true length of the train. If the train is not completely stretched or bunched, the cars may be in a process of run-in or run-out. The methods of determining the grade the track and the locomotive as well as the curvature will be described with respect to FIGS. 1B and 1C. This would be one method of determining whether the train is on a straight level track.

Another method would be taking a plurality of readings and determining the differences of the positions and using the longest length as the length of the train. Also, by monitoring the length of the train at different times, and the differences of the length, it could be determined whether the train is experiencing run-in or run-out occupying a curve as well as determining in-train forces.

The accuracy of the length of the train determined from the positioning determining devices can be measured by comparison with the number of cars in the train. By using the number of cars in the train, an estimate of the length can be produced and compared against the length determined by the position determining devices. Any discrepancies can be reported. This would indicate that there is an error either in the supposed number of cars in the train or the length determined by the position determining devices.

The number of vehicles in the train can be determined from a listing of the consist of the vehicles in the train. This could include the number of vehicles, the type of vehicles and the length of the vehicles. An alternate source for this information would be a hot box detection system. As illustrated in FIG. 1, the hot box detection system 20 is located adjacent to the tracks. The detector counts axles as they travel pass the sensor and note whether the thermal signature of any axis is beyond the normal limits. The condition of each axle is radio transmitted to the locomotives 12, 14. From the report of the hot box detection system, the number of axles in the train can be determined. Knowing the number of axles, the number of cars can be determined and again, this can be used to estimate the length of the train.

Figure 3:
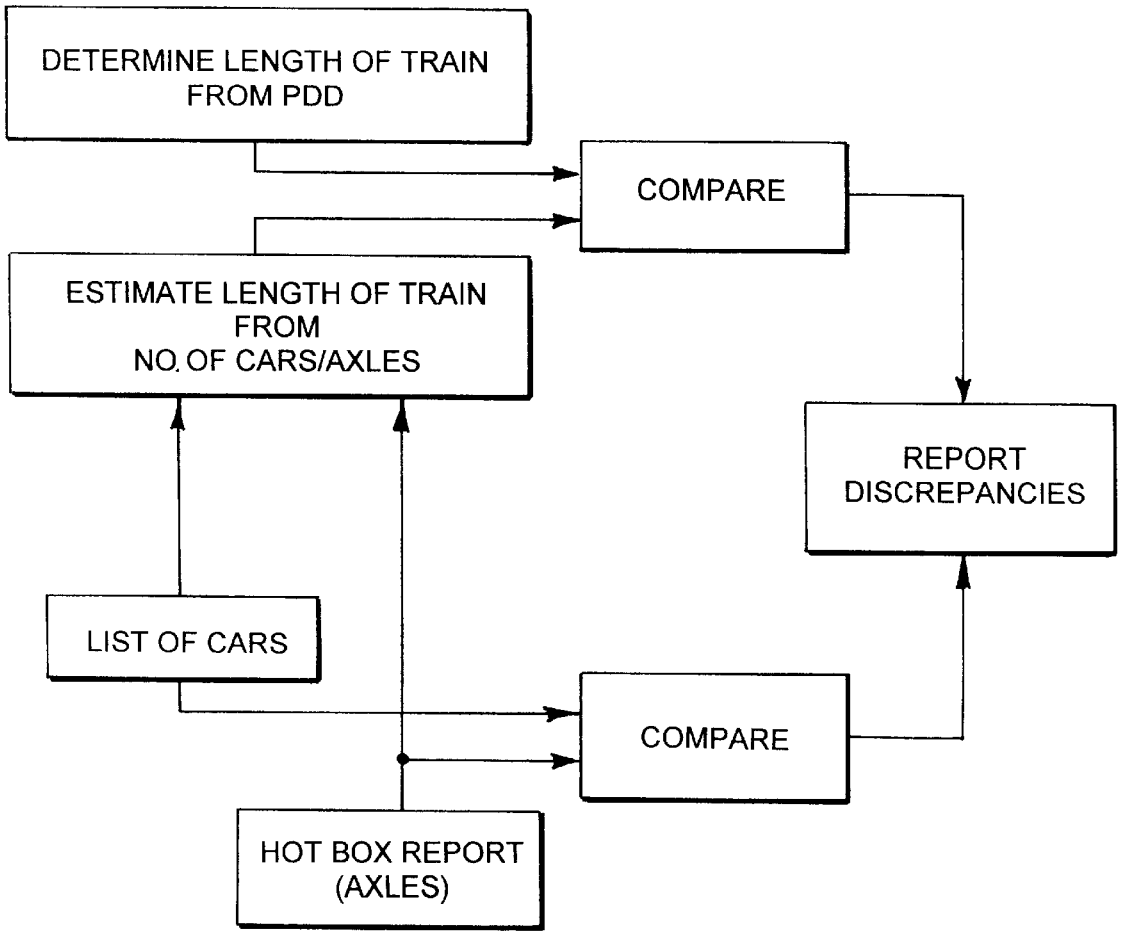
FIG. 3 is a flow chart for a method of determining discrepancies according to the principles of the present invention.

It should also be noted that discrepancies in the train can be determined by comparing the number of cars in the list on the train with the information based on the number of axles in the hot box detection system. Any discrepancies in the list of the report will be determined and reported. This will provide an indication of either that the list of the consist is inaccurate or that the hot box detection system report is inaccurate. Flow charts for both of these are illustrated in FIG. 3.

A method of determining the grade of the train and consequently the track using the two displaced navigational receivers is also determined using the elevation or altitude of the two navigational receivers. The elevation is generally the distance above sea level. The difference between elevation E1 and E2 in FIG. 1B is their vertical distance. The vertical distance V divided by the length L times 100% yields the grade of the track occupied by the train. Again, to increase the accuracy of this information, the train should be on a straight and not a curved portion of the track. The information of the grade can be used to create a data base of the track and/or to upgrade an existing data base of the track profile.

The curvature of the track can be determined as illustrated in FIG. 1C by receiving the latitude and longitude and heading from the two displaced navigational receivers. The difference in their position transverse to the center line of the track divided by the length L times 100% equals the curvature C of the track. As with the grade of the track, this information can be used to derive the characteristic of the track to create the data base for the track profile or to update the track profile in a data base.

The information from the navigational receivers along with a tachometer are stored as a function of time and position automatically while the train 10 traverses the track 18. This information can then be analyzed or processed onboard the train for instantaneous update and storing as well as display to the engineer.

Given sufficient position determining devices, throughout the train, the position data can be used to determine curvature or grade by creating a set of piece-wise linear functions which represent the line connecting each position determining device. This would in effect trace the grade or curvature characteristic of the track occupied. Through time, a composite data base will be built which would accurately represent the track shape.

Figure 2:
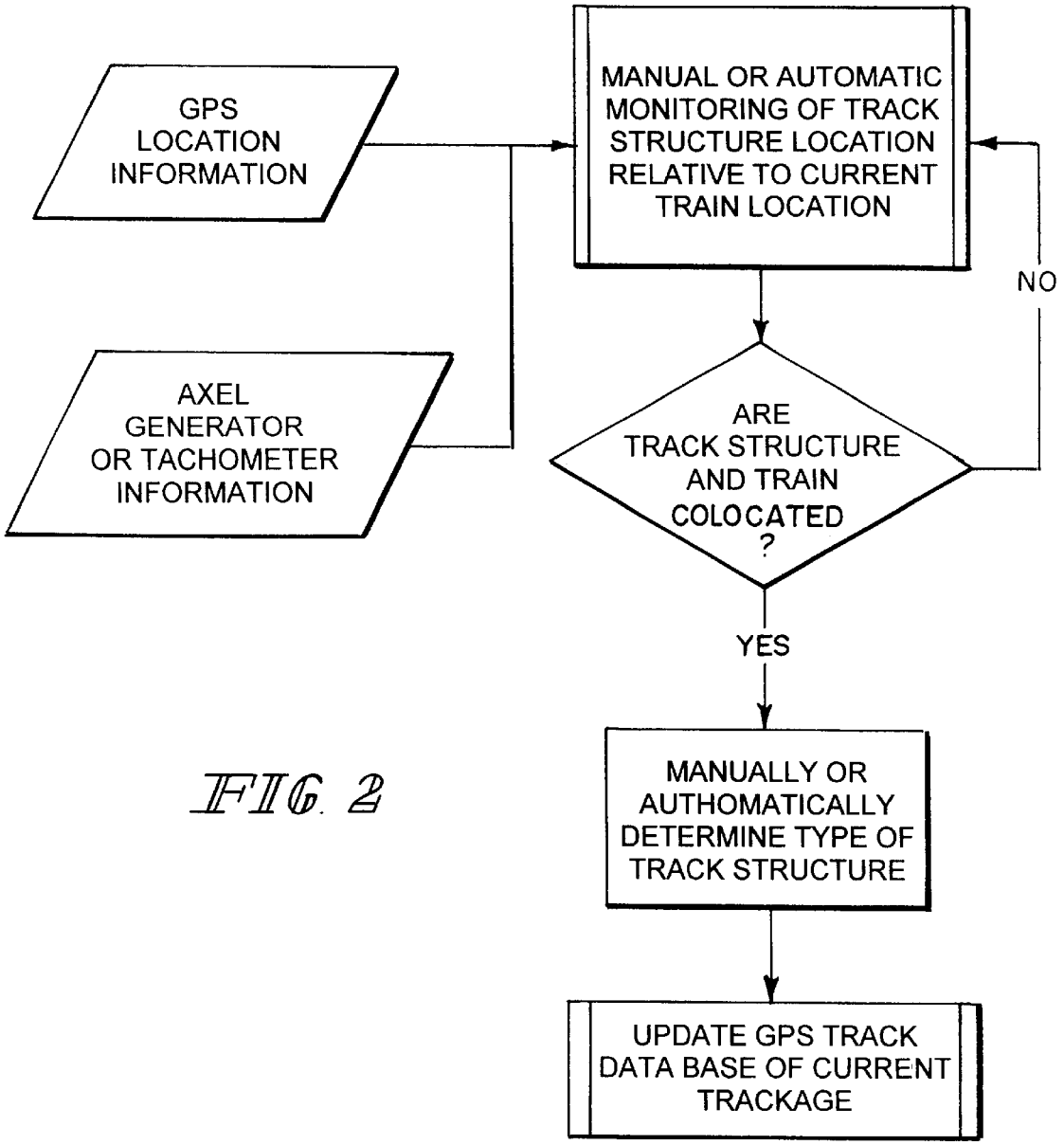
FIG. 2 illustrates a flow chart for a method of deriving or updating track profile according to the principles of the present invention.

Track structure and other information about the track may also be collected as the train 10 traverses the track 18. As illustrated in FIG. 2, the GPS information as well as the information of the distance travel from the axle generator or tachometer information are collected as a function of position or time and correlated with structures relative the current location. If there are track structures which are of interest and that are to be correlated with the train location, they are manually or automatically determined and inputted. This information includes one or more mile posts, bridges, tunnels, signals, crossings, overpasses, underpasses, sidings, parallel track and whistle posts. The manual entry would be by the engineer or another observer in the lead locomotive 12. There may also be someone in the trail locomotive 14. If the particular track structure has a transponder, the train can automatically correlate the information with the position as it passes by and receives the signal from the transponder.

As previously mentioned, more than two navigational receivers or GPS systems may be provided throughout the train. If such information is provided, then multiple segments can be measured which would indicate the length of that segment as well as whether that segment is in run-in or run-out and also to be used as reflection of in-train forces for that segment. Also, it will provide a more accurate determination of the elevation or curvature for that segment between a pair of navigational receivers or position determining devices.

It should also be noted that knowing the position of at least two points of the train, a more accurate determination of where the train is on the track may be determined by comparison with prestored data bases. This position can be displayed or used with the previously mentioned systems of the prior art.

The location or determination of the location of the train is generally a function of the accuracy of the GPS data stream. The GPS data stream includes an ever present error which constantly changes such that the exact precise location can never be exactly as reported. However, the error does change at a significantly slow rate. Thus, for a relatively small time periods, the error can be considered effectively constant. The error becomes a bigger factor when a train goes through a switch where there are a pair of branch tracks available. If these tracks were parallel and not displaced by a very large distance, most systems cannot differentiate between the two tracks. Prior art systems have used the heading as an indication of which branch the train is on after passing through the switch. The present system provides a method of determining which track without the use of a heading. Two measurements are made: the first, substantially at or before the switch and the second, after the switch. The measurements may be made simultaneously by two spaced positions determining devices, for example, GPS. Alternatively, two readings may be made by a single position determining device sequentially in time as it moves from before to after the switch.

Figure 4A:
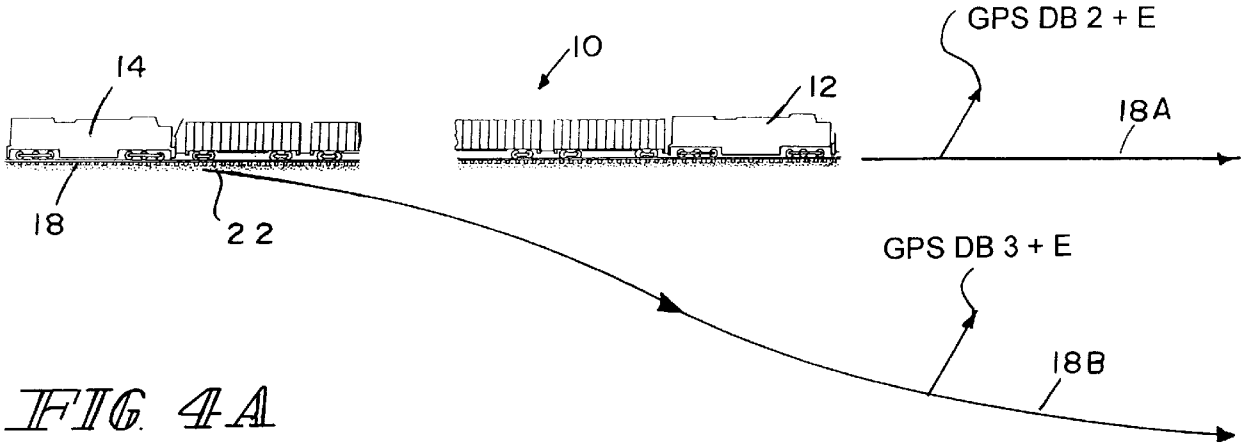
FIG. 4A is a view of a train on a track having a switch with two parallel tracks according to the principles of the present invention.

FIG. 4A illustrates the method of the simultaneous measurement. The train 10 is shown as including position determining devices at positions 12 and 14. The track 18 splits at switch 22 to track 18A and track 18B. The simultaneous measurements at 12 and 14 are compared against the data base locations. The GPS signal for position 1 measured by 14 is compared to the database position 1 to produced an error E. The error E of the GPS signal is added to the GPS DB (database) for positions 2 and 3. The GPS data measured at 12 is then compared against the GPS 2 plus Error and GPS 3 plus Error. The one that it is closer to is the assumed location. The vector shown in FIGS. 4A and 4B is the direction and amplitude of the error E measured at the position 14 prior to the switch 22 and added to the database positions 2 and 3.

Figure 4B:
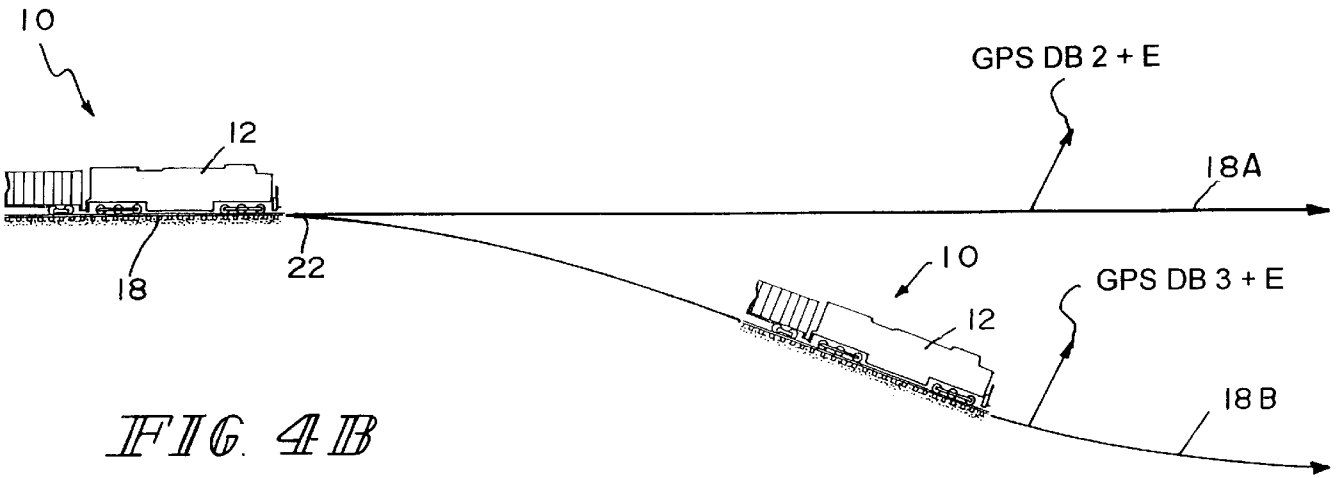
FIG. 4B is a view of a train at two points in time on a track having a switch with two parallel tracks according to the principles of the present invention.

An alternate method of coming to the same results is illustrated in FIG. 4B. A single position locating device at 12 takes sequential measurements prior to or at the switch 22 and subsequently on one of the tracks 18A or 18B. The time difference between these two should be relatively small such that the error can be assumed the same. Thus, again, the position determined at or prior to switch 22 by the GPS is compared against the data base location to determine an error E. This error E is added to the GPS data base position 2 an 3 and compared against the GPS measured signal at a point past the switch 22. The comparison having the least difference is the assumed location. As discussed previously, there may be more position determining devices other than the front of the train 12 and the rear of the train 14.

Figure 5:
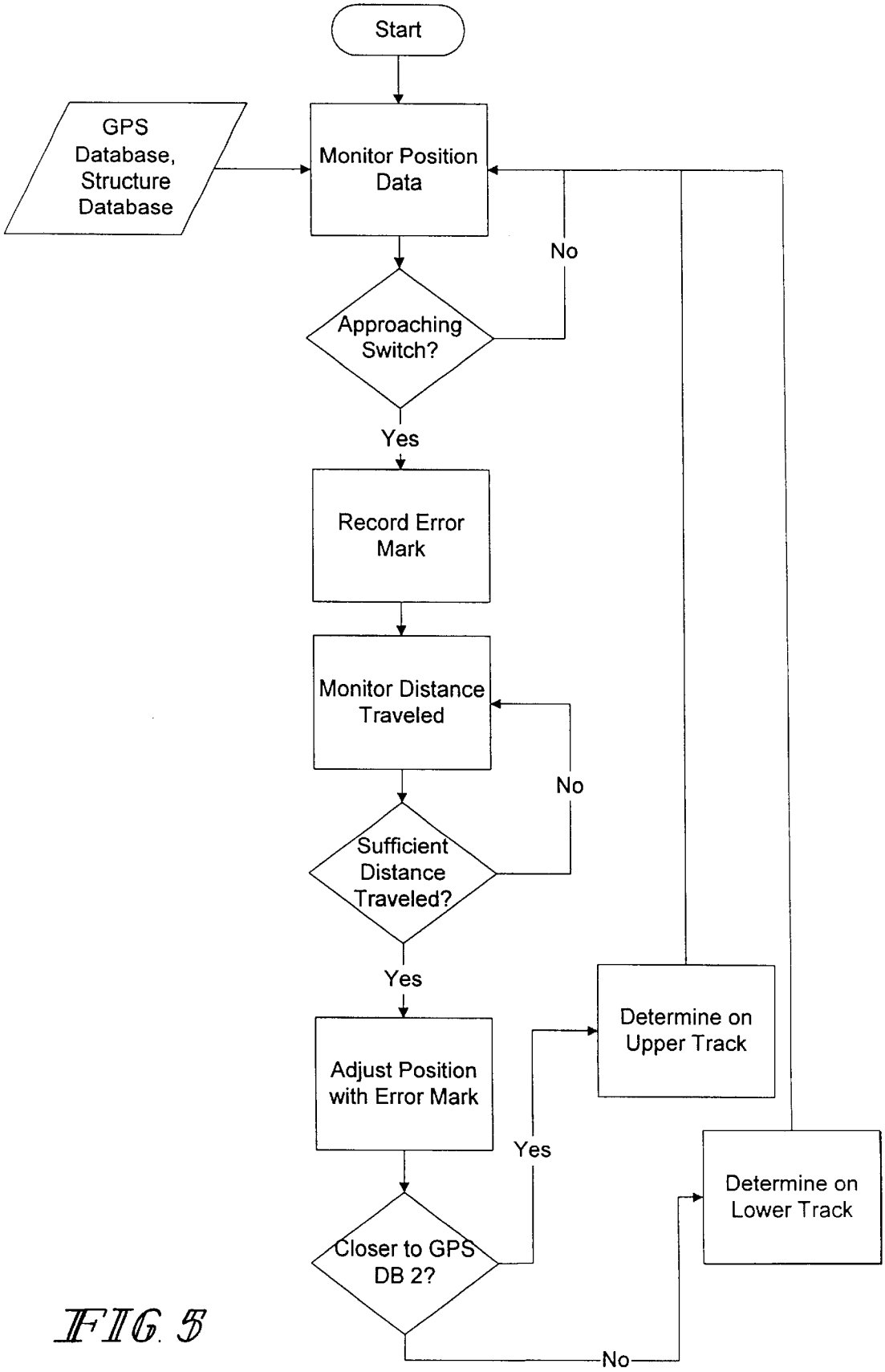
FIG. 5 is a flow chart of a method for determining which of two parallel tracks the train is on according to the principles of the present invention.

The method for determining which of two parallel tracks the train is on may be determined using the flow chart of FIG. 5. The position data for the GPS data base and structure data bases are monitored. Next, it is determined whether a switch is being approached. If not, the position data is continued to be monitored. If the train is approaching a switch, the error with respect to the database is determined and recorded. Next, the distance traveled is monitored and a determination is made whether a sufficient distance has been traveled. If not, it loops back to monitoring. If a sufficient distance has been traveled, then there is an adjustment of the second position with the determined error. The adjusted position is then compared to one of the GPS determined positions. In this case, it is compared to the straight track GPS DB2. If it is closer to the GPS DB2, then the train is determined to be on the upper track 18A. If not, the train is on the lower track 18B. Once this has been determined, the system cycles back to monitoring the position data and determine whether the train is approaching another switch. Flow chart 5 is just an example of the flow chart to implement the method of determining which track the train is on.

In both methods of determination, that the train has passed through a switch 22 may be determined from an external input, for example, by the operator, a transponder adjacent the switch track siting. Alternatively, it can be determined by the programming software based on the location along track 18 prior to the switch 22.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A method of determining location of a train having rail vehicles on a track, the method comprising:

determining a first position of a portion of the train prior to or at a switch in the track;

determining a second position of a portion of the train after the switch in the track;

comparing the determined first and second positions to a data base on the train; and determining which branch track the train is on from a comparison of the positions to the data base.

2. A method according to claim 1, wherein the first and second positions are determined simultaneously at two spaced portions of the train.

3. A method according to claim 1, wherein the first and second positions are determined sequentially at the same portion of the train.

4. A method according to claim 1, wherein determining the location of the train on the track from the comparison includes determining an error between the first determined position and the data base and assume the same error for the second determined position.

* * * * *